US011577930B2

(12) United States Patent
Huang et al.

(10) Patent No.: US 11,577,930 B2
(45) Date of Patent: Feb. 14, 2023

(54) AUTOMATIC ELEVATOR CALLING SYSTEM AND A METHOD FOR CONTROLLING AUTOMATIC CALLING ELEVATOR

(71) Applicant: Otis Elevator Company, Farmington, CT (US)

(72) Inventors: Wenbo Huang, Shanghai (CN); Xiaofei Guo, Shanghai (CN); Haiyan Xue, Shanghai (CN); Renxiang Chen, Shanghai (CN); Heping Qiu, Shanghai (CN); Lieping Wei, Shanghai (CN); Tan Liu, Shanghai (CN); Jingyu Tong, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 1084 days.

(21) Appl. No.: 16/233,819

(22) Filed: Dec. 27, 2018

(65) Prior Publication Data

US 2019/0193988 A1 Jun. 27, 2019

(30) Foreign Application Priority Data

Dec. 27, 2017 (CN) ..... 201711441899.0

(51) Int. Cl.
*B66B 1/46* (2006.01)

(52) U.S. Cl.
CPC ..... *B66B 1/468* (2013.01); *B66B 2201/4615* (2013.01); *B66B 2201/4653* (2013.01); *B66B 2201/4684* (2013.01)

(58) Field of Classification Search
CPC ..... B66B 1/468; B66B 2201/4615; B66B 2201/4653; B66B 2201/4684; B66B 1/18; B66B 1/3461; B66B 2201/4638
(Continued)

(56) References Cited

U.S. PATENT DOCUMENTS 3,519,102 A 7/1970 Saving
6,397,976 B1 6/2002 Hale et al.
(Continued)

FOREIGN PATENT DOCUMENTS

CN 101810023 A * 8/2010 ..... H04W 24/10
CN 101955093 B 2/2013
(Continued)

OTHER PUBLICATIONS

Kwon, Ohhoon et al., "Sensor-aware elevator scheduling for smart building environments", abstract, vol. 72, Feb. 2014, 2 pages.
(Continued)

*Primary Examiner* — Mahendra R Patel
(74) *Attorney, Agent, or Firm* — Cantor Colburn LLP

(57) ABSTRACT

The present invention relates to automatic elevator call control, and belongs to the field of elevator intelligent control technologies. An automatic elevator call system provided in the present invention calculates duration information from the moment when the personal mobile terminal leaves coverage of the wireless signal to the moment when the personal mobile terminal enters the coverage again, and when the duration information is less than or equal to a preset time threshold, causes the personal mobile terminal to be incapable of automatically sending an elevator call request command in a time period from the moment when the personal mobile terminal enters the coverage again to the moment when the personal mobile terminal leaves the coverage again. The present invention can effectively avoid invalid or abnormal elevator call request operations, and the elevator system achieves high running efficiency.

17 Claims, 4 Drawing Sheets

(58) Field of Classification Search
USPC ..... 187/381
See application file for complete search history.

(56) References Cited

U.S. PATENT DOCUMENTS

| | | | | |
|---|---|---|---|---|
| 7,155,317 | B1 | 12/2006 | Tran | |
| 7,552,800 | B2 | 6/2009 | Puskala et al. | |
| 8,538,596 | B2 | 9/2013 | Gu et al. | |
| 8,960,373 | B2 | 2/2015 | De Vincentis | |
| 9,265,128 | B2 | 2/2016 | Steiner et al. | |
| 9,725,279 | B2 | 8/2017 | Armistead | |
| 2010/0315208 | A1* | 12/2010 | Takeuchi | B66B 1/468 340/286.06 |
| 2015/0068849 | A1* | 3/2015 | Haipus | B66B 1/468 187/384 |
| 2015/0210505 | A1* | 7/2015 | Fujiwara | B66B 1/468 187/381 |
| 2016/0221791 | A1* | 8/2016 | Berryhill | B66B 1/2458 |
| 2016/0311647 | A1* | 10/2016 | Peterson | B66B 5/0012 |
| 2017/0197807 | A1* | 7/2017 | Noda | H04N 7/185 |
| 2017/0291800 | A1* | 10/2017 | Scoville | H04W 76/10 |
| 2018/0346283 | A1* | 12/2018 | Scoville | B66B 5/0012 |

FOREIGN PATENT DOCUMENTS

| | | | | | |
|---|---|---|---|---|---|
| CN | 104270547 | A | * | 1/2015 | G08C 17/00 |
| CN | 104760851 | B | | 9/2016 | |
| CN | 107074484 | A | | 8/2017 | |
| EP | 2855319 | B1 | | 4/2015 | |
| EP | 3234875 | A1 | | 6/2016 | |
| EP | 3228576 | A1 | * | 10/2017 | B66B 1/3407 |
| JP | 2003341945 | A | * | 12/2003 | |
| TW | 201633211 | A | * | 9/2016 | G06K 7/10297 |
| WO | 0164571 | A1 | | 9/2001 | |
| WO | WO-2009107206 | A1 | * | 9/2009 | B66B 1/468 |
| WO | 2014178790 | A1 | | 11/2014 | |
| WO | WO-2015094178 | A1 | * | 6/2015 | B66B 1/3461 |

OTHER PUBLICATIONS

Munir, Sirajum, "Real-Time Fine Grained Occupancy Estimation Using Depth Sensors on ARM Embedded Platforms", abstract, 2017 IEEE Real-Time and Embedded Technology and Applications Symposium (RTAS), 1 page.

European Search Report for application 18215167.0, dated May 17, 2017, 8 pages.

* cited by examiner

AUTOMATIC ELEVATOR CALLING SYSTEM AND A METHOD FOR CONTROLLING AUTOMATIC CALLING ELEVATOR

FOREIGN PRIORITY

This application claims priority to Chinese Patent Application No. 201711441899.0, filed Dec. 27, 2017, and all the benefits accruing therefrom under 35 U.S.C. § 119, the contents of which in its entirety are herein incorporated by reference.

TECHNICAL FIELD

The present invention belongs to the field of elevator intelligent control technologies, and relates to an automatic elevator call system and an automatic elevator call control method.

BACKGROUND ART

In an elevator system, an elevator call request operation that fails to reflect a real elevator-taking service requirement of a passenger will affect the efficiency of the elevator system. Especially, repeated abnormal elevator call request operations in a short time period will significantly affect the efficiency of the elevator system.

SUMMARY OF THE INVENTION

According to a first aspect of the present invention, an automatic elevator call system is provided, including: a wireless signal apparatus, installed in an elevator landing zone of an elevator system and broadcasting a corresponding wireless signal around; wherein the wireless signal apparatus receives an elevator call request command automatically sent by a personal mobile terminal carried by a passenger in the case where the personal mobile terminal senses the wireless signal; wherein the automatic elevator call system further includes: a timing unit configured to calculate duration information from the moment when the personal mobile terminal leaves coverage of the wireless signal to the moment when the personal mobile terminal enters the coverage again; and an enabling unit configured to: when the duration information is less than or equal to a preset time threshold, cause the personal mobile terminal to be incapable of automatically sending the elevator call request command in a time period from the moment when the personal mobile terminal enters the coverage again to the moment when the personal mobile terminal leaves the coverage again.

In the automatic elevator call system according to an embodiment of the present invention, the timing unit and/or the enabling unit are/is disposed in the personal mobile terminal carried by the passenger.

In the automatic elevator call system according to an embodiment of the present invention, the enabling unit is further configured to: when the duration information is greater than the preset time threshold, cause the personal mobile terminal to be capable of automatically sending the elevator call request command normally in a time period from the moment when the personal mobile terminal enters the coverage again to the moment when the personal mobile terminal leaves the coverage again.

In the automatic elevator call system according to an embodiment of the present invention, the time threshold is greater than or equal to 15 seconds and less than or equal to 2 minutes.

In the automatic elevator call system according to an embodiment of the present invention, the time threshold is greater than or equal to 30 seconds and less than or equal to 1 minute.

In the automatic elevator call system according to an embodiment of the present invention, the automatic elevator call system further includes a short range communication unit disposed in the personal mobile terminal, and the short range communication unit is configured to sense the wireless signal and determine whether the personal mobile terminal leaves or enters the coverage.

In the automatic elevator call system according to an embodiment of the present invention, the short range communication unit is further configured to determine that the personal mobile terminal leaves the coverage in the case where the wireless signal is sensed at first and then not sensed or in the case where signal strength of the sensed wireless signal gradually decreases to approximately 0; and the short range communication unit is further configured to determine that the personal mobile terminal enters the coverage in the case where the wireless signal is not sensed at first and then sensed.

The automatic elevator call system according to an embodiment of the present invention further includes an elevator call request command generating unit disposed in the personal mobile terminal, wherein the elevator call request command generating unit is configured to automatically generate the corresponding elevator call request command when signal strength of the sensed wireless signal is greater than or equal to trigger threshold strength.

In the automatic elevator call system according to an embodiment of the present invention, the enabling unit is further configured to be capable of automatically sending the elevator call request command only once in a time range from the moment of entering the coverage to the moment of leaving the coverage.

The automatic elevator call system according to an embodiment of the present invention further includes an input unit disposed in the personal mobile terminal, wherein the input unit is configured to input request service information about the elevator call request command.

In the automatic elevator call system according to an embodiment of the present invention, the wireless signal apparatus is a Bluetooth module/Bluetooth Low Energy (BLE) module, and the wireless signal is a Bluetooth signal/BLE signal.

According to a second aspect of the present invention, an automatic elevator call control method is provided, including steps of: sensing a wireless signal broadcasted by a wireless signal apparatus installed in an elevator landing zone of an elevator system; calculating duration information from the moment when a personal mobile terminal leaves coverage of the wireless signal to the moment when the personal mobile terminal enters the coverage again; and when the duration information is less than or equal to a preset time threshold, causing the personal mobile terminal to be incapable of automatically sending an elevator call request command in a time period from the moment when the personal mobile terminal enters the coverage again to the moment when the personal mobile terminal leaves the coverage again.

The automatic elevator call control method according to an embodiment of the present invention further includes a step of: when the duration information is greater than the preset time threshold, causing the personal mobile terminal to be capable of automatically sending the elevator call request command normally in a time period from the moment when the personal mobile terminal enters the coverage again to the moment when the personal mobile terminal leaves the coverage again.

The automatic elevator call control method according to an embodiment of the present invention further includes steps of: determining that the personal mobile terminal leaves the coverage in the case where the wireless signal is sensed at first and then not sensed or in the case where signal strength of the sensed wireless signal gradually decreases to approximately 0; and determining that the personal mobile terminal enters the coverage in the case where the wireless signal is not sensed at first and then sensed.

The automatic elevator call control method according to an embodiment of the present invention further includes a step of: automatically generating the corresponding elevator call request command when signal strength of the sensed wireless signal is greater than or equal to trigger threshold strength.

In the automatic elevator call control method according to an embodiment of the present invention, the elevator call request command can be automatically sent only once in a time range from the moment of entering the coverage to the moment of leaving the coverage.

The automatic elevator call control method according to an embodiment of the present invention further includes a step of: manually inputting request service information about the elevator call request command.

According to a third aspect of the present invention, a computer readable storage medium is provided, storing a computer program, wherein the program can be executed by a processor to implement steps of any automatic elevator call control method described above.

According to a fourth aspect of the present invention, an elevator system is provided, including: any automatic elevator call system described above; and an elevator controller configured to control running of one or more elevator cars in the elevator system; wherein the elevator controller is coupled to the wireless signal apparatus and controls the running of the one or more elevator cars in the elevator system in response to at least the elevator call request command.

According to a fifth aspect of the present invention, a personal mobile terminal is provided, the personal mobile terminal being configured to sense a wireless signal broadcasted by a wireless signal apparatus installed in an elevator landing zone of an elevator system and automatically send an elevator call request command to the wireless signal apparatus, wherein the personal mobile terminal includes: a timing unit configured to calculate duration information from the moment when the personal mobile terminal leaves coverage of the wireless signal to the moment when the personal mobile terminal enters the coverage again; and an enabling unit configured to: when the duration information is less than or equal to a preset time threshold, cause the personal mobile terminal to be incapable of automatically sending the elevator call request command in a time period from the moment when the personal mobile terminal enters the coverage again to the moment when the personal mobile terminal leaves the coverage again.

According to a sixth aspect of the present invention, a personal mobile terminal is provided, including a memory, a processor, and a computer program that is stored in the memory and capable of running on the processor, wherein the processor implements steps of any automatic elevator call control method described above when executing the program.

The foregoing features and operations of the present invention will become more obvious according to the following description and the accompanying drawings.

BRIEF DESCRIPTION OF THE DRAWINGS

The following detailed description with reference to the accompanying drawings will make the foregoing and other objectives and advantages of the present invention more complete and clearer, wherein identical or similar elements are represented by using identical reference numerals.

DETAILED DESCRIPTION

The present invention is now described more thoroughly with reference to the accompanying drawings. The drawings show exemplary embodiments of the present invention. However, the present invention can be implemented according to many different forms, and should not be construed as being limited by the embodiments illustrated herein. On the contrary, these embodiments are provided to make the present disclosure thorough and complete, and fully convey the idea of the present invention to those skilled in the art.

Some block diagrams shown in the accompanying drawings are functional entities, which do not necessarily correspond to physically or logically independent entities. The functional entities can be implemented in a software form, or implemented in one or more hardware modules or integrated circuits, or implemented in different processing apparatuses and/or micro control apparatuses.

Figure 1:
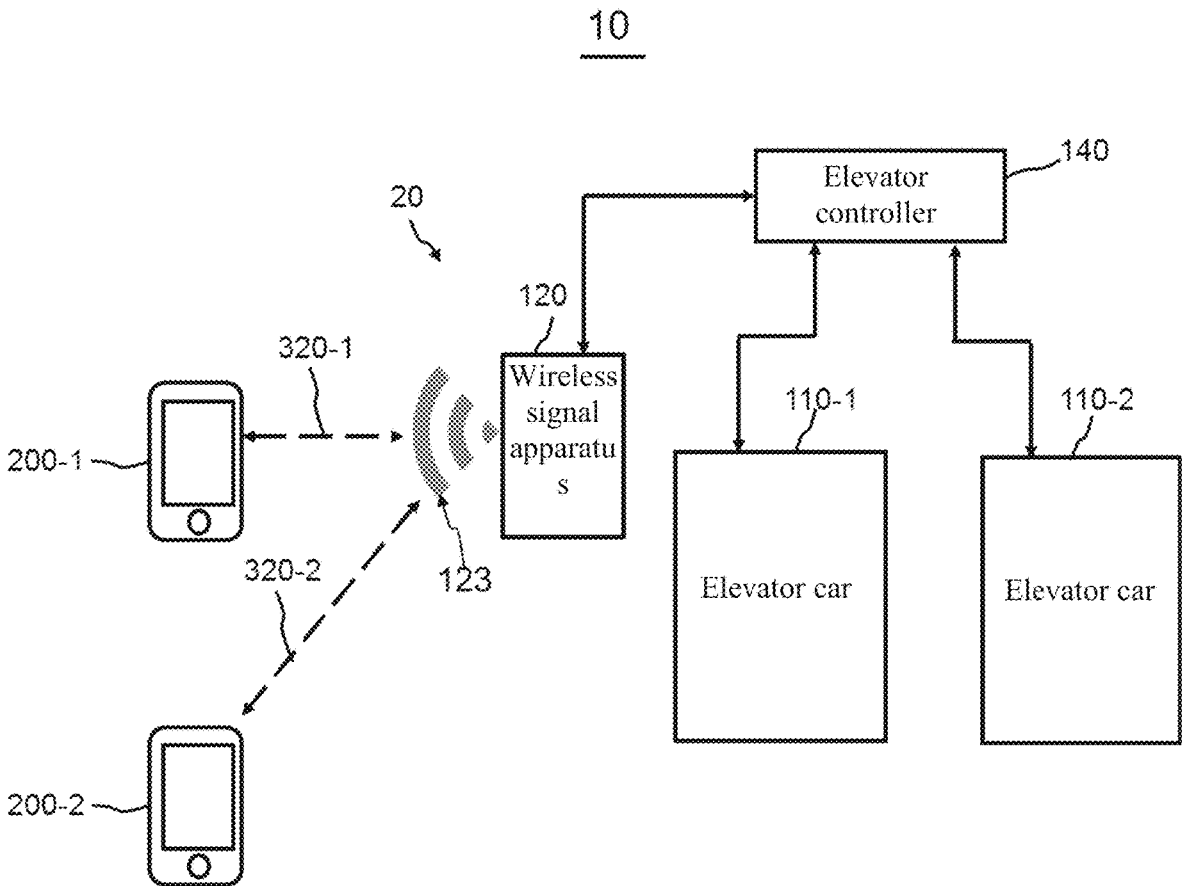
FIG. 1 is a schematic diagram of an elevator system according to an embodiment of the present invention, in which an automatic elevator call system of an embodiment of the present invention is used.
Figure 2:
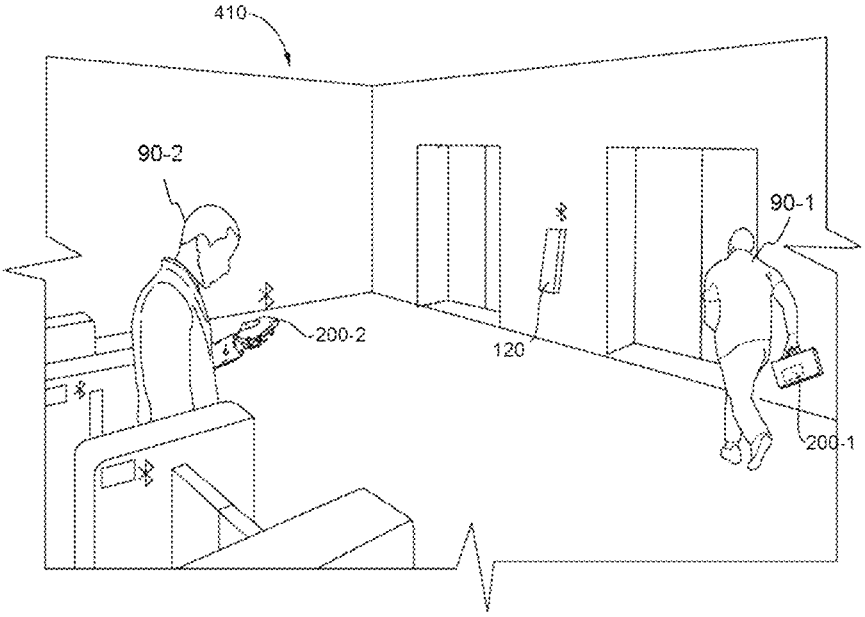
FIG. 2 is a schematic diagram of an application scenario of an elevator system according to an embodiment of the present invention.
Figure 3:
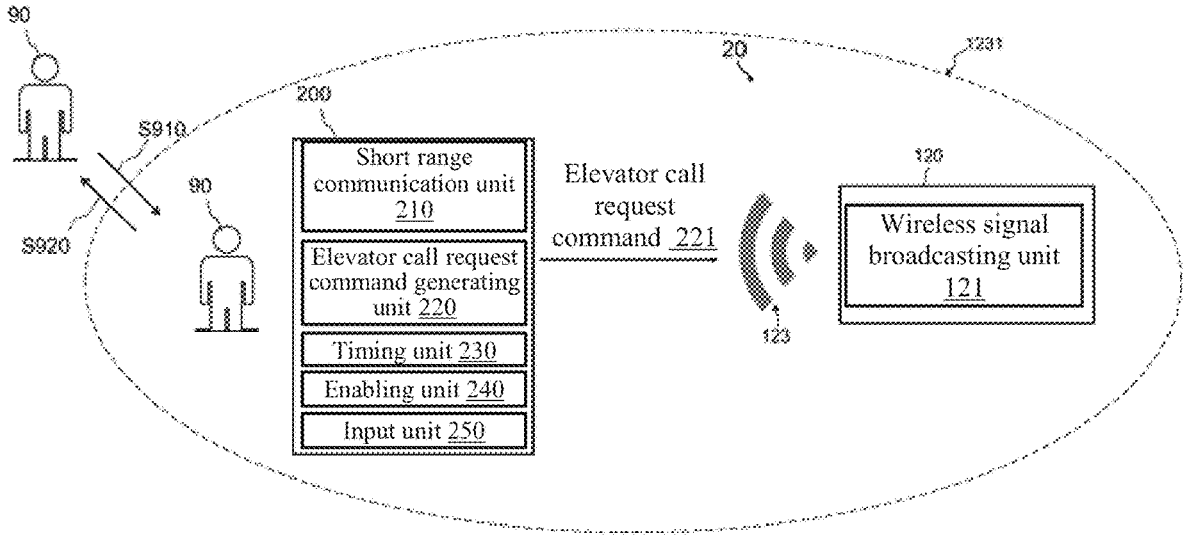
FIG. 3 is a schematic diagram of an automatic elevator call system according to an embodiment of the present invention.

FIG. 1 is a schematic diagram of an elevator system according to an embodiment of the present invention. FIG. 2 is a schematic diagram of an application scenario of an elevator system according to an embodiment of the present invention. FIG. 3 is a schematic diagram of an automatic elevator call system according to an embodiment of the present invention. An elevator system 10, an automatic elevator call system 20 and a personal mobile terminal 200 according to an embodiment of the present invention are illustrated in detail below with reference to FIG. 1, FIG. 2 and FIG. 3.

The elevator system 10 according to the embodiment of the present invention can be installed in various buildings. The elevator system 10 includes multiple elevator cars 110 that move up and down in a hoistway of a building. FIG. 1 shows two elevator cars, that is, elevator cars 110-1 and 110-2. Each elevator car 110 is under the control (such as scheduling control and movement control) of an elevator controller 140 in the elevator system 10, so as to move in the hoistway or stop at the corresponding landing. Generally, the elevator controller 140 needs to acquire elevator call request commands from elevator landing zones 410 of various floors, thus performing operational control on the elevator based on the commands, for example, performing scheduling control on the elevator cars 110. It will be appreciated that the specific control manner or control principle based on which the elevator controller 140 controls the one or more elevator cars 110 is not limited, and the specific structure, arrangement manner or the like of the elevator controller 140 is not limited either.

In order to acquire the elevator call request command from each elevator landing zone 410, a wireless signal apparatus 120 is disposed in the elevator system 10. The wireless signal apparatus 120 can be, for example, a beacon that broadcasts a wireless signal, and can be installed in each elevator landing zone 410 of the elevator system 10 (as shown in FIG. 2). For example, at least one wireless signal apparatus 120 is installed at each floor or each elevator landing zone 410, so that wireless signals 123 sent out or broadcasted by the wireless signal apparatuses 120 can effectively cover each elevator landing zone 410 approximately.

In an embodiment, as shown in FIG. 3, a wireless signal broadcasting unit 121 is disposed in the wireless signal apparatus 120 and is configured to broadcast the wireless signal 123, for example, broadcast a wireless signal of particular signal strength, so that the wireless signal 123 can cover a predetermined area (i.e., coverage). Coverage of a wireless signal 123*d* is, for example, an area in which the personal mobile terminal 200 can sense the wireless signal 123 (such as coverage where the signal strength is greater than or equal to 0). Due to different sensing capabilities of the personal mobile terminals 200, the coverage may be of different sizes for different personal mobile terminals 200. It will be appreciated that the coverage can be known in advance by test.

Correspondingly, the wireless signal 123 broadcasted by the wireless signal apparatus 120 can be sensed by the personal mobile terminal 200. FIG. 1 shows two personal mobile terminals 200-1 and 200-2 as an example, which are carried by different passengers 90-1 and 90-2 respectively and can be at least configured to complete an elevator call request operation. The wireless signal apparatus 120 is a main component of the automatic elevator call system 20 in the embodiment of the present invention. The automatic elevator call system 20 can implement some of functions thereof by means of the personal mobile terminal 200. When approaching the wireless signal apparatus 120 (for example, walking towards the elevator landing zone 410), different passengers 90-1 and 90-2 will enter the coverage of the wireless signal 123. The personal mobile terminals 200 carried by the passengers cannot sense the wireless signal 123 at first, and then can sense the wireless signal 123. Specifically, as shown in FIG. 3, each personal mobile terminal 200 senses the wireless signal 123 by using a short range communication unit 210 disposed in the personal mobile terminal 200, and can interact (for example, establish a wireless connection) with the wireless signal apparatus 120 based on the wireless signal 123 if necessary. For example, the personal mobile terminal 200-1 implements an interaction 320-1 with the wireless signal apparatus 120, and the personal mobile terminal 200-2 implements an interaction 320-2 with the wireless signal apparatus 120.

The personal mobile terminal 200 specifically can be various intelligent terminals having a wireless connection function, and can be conveniently carried by a passenger. For example, the personal mobile terminal 200 may be a smart phone, a wearable smart device (such as a smart band), a personal digital assistant (PAD), and so on. A corresponding application component (such as APP) can be installed on the personal mobile terminal 200 to implement corresponding functions of the present invention.

In an embodiment, the wireless signal apparatus 120 can be a Bluetooth module, and specifically can be a Bluetooth Low Energy (BLE) module. The wireless signal 123 transmitted or broadcasted by the wireless signal broadcasting unit 121 of the wireless signal apparatus 120 is a Bluetooth signal (such as a BLE signal) which can approximately cover the elevator landing zone 410 where it is located. Correspondingly, the short range communication unit 210 of the personal mobile terminal 200 is a Bluetooth communication unit, which can sense a Bluetooth signal, such as a BLE signal.

In an embodiment, the wireless signal 123 (such as a BLE signal) can include a wakeup signal for waking up the personal mobile terminal 200. The personal mobile terminal 200 that senses the wakeup signal can wake up a corresponding application component (such as an automatic elevator call APP) of the personal mobile terminal 200 to work. The wireless signal 123 can further include a data signal reflecting a universally unique identifier (UUID) of the wireless signal apparatus 120 and/or information about a floor position of the wireless signal apparatus 120.

In an implementation solution, the strength of the wireless signal 123 attenuates with its propagation distance. Therefore, the personal mobile terminal 200 receiving the wireless signal 123 can roughly determine a current distance D1 between the personal mobile terminal 200 and the wireless signal apparatus 123 according to signal strength of the sensed wireless signal 123. It will be appreciated that as the passenger walks relative to the elevator landing zone 410 or walks in the elevator landing zone 410, the distance D1 changes dynamically.

Still as shown in FIG. 3, an elevator call request command generating unit 220 is further disposed in the personal mobile terminal 200, which is configured to generate a corresponding elevator call request command 221. The elevator call request command 221 at least includes elevator call direction information, and can further include at least one of destination floor information, elevator call floor information, and target elevator information. The elevator call request command 221 can be sent to the wireless signal apparatus 120 through the short range communication unit 210 of the personal mobile terminal 200, and then the wireless signal apparatus 120 can transmit the elevator call request command 221 to the elevator controller 140 (for example, in the case where the interaction 320 has been established). The specific form and/or the specific generation manner of the elevator call request command 221 are/is not limited.

In an embodiment, still as shown in FIG. 3, the reference numeral 1231 represents a boundary of the coverage of the wireless signal 123 broadcasted by the wireless signal apparatus 120. The value of signal strength at the boundary 1231 can be determined depending on a sensing capability of the personal mobile terminal 200. The short range communication unit 210 is further configured to determine whether the personal mobile terminal 200 leaves the coverage (indicated by the reference numeral S920 shown in the figure) or enters the coverage (indicated by the reference numeral S910 shown in the figure). If the short range communication unit 210 senses the wireless signal 123 at first and then does not sense the wireless signal 123, or signal strength of the wireless signal 123 sensed by the short range communication unit 210 gradually decreases to approximately 0, the short range communication unit 210 determines that the personal mobile terminal 200 leaves the coverage, i.e., S920. If the short range communication unit 210 does not sense the wireless signal 123 at first and then senses the wireless signal 123, the short range communication unit 210 determines that the personal mobile terminal 200 enters the coverage, i.e., S910. Therefore, even if the passenger 90 moves back and forth frequently on two sides of the boundary 1231, the short range communication unit 210 can determine the passenger 90 enters the coverage S910 or leaves the coverage S920 each time the passenger 90 moves back and forth.

It should be noted that the boundary 1231 of the coverage of the wireless signal 123 may not be fixed. For example, the signal strength of the wireless signal 123 broadcasted by the wireless signal apparatus 120 may change dynamically. For personal mobile terminals 200 with different sensing capabilities, the coverage of the wireless signal 123 may be different, that is, the boundary 1231 may be at different positions. The signal strength at the boundary 1231 of the coverage of the wireless signal 123 is not necessarily approximately 0, and the specific value of the signal strength at the boundary 1231 can be defined as required. For example, in other embodiments, the coverage of the wireless signal 123 may refer to an area in which signal strength is greater than or equal to a predetermined value. The predetermined value can be set or determined according to a specific situation.

It should be noted that at the moment when the personal mobile terminal 200 enters the coverage, the elevator call request command generating unit 220 is not necessarily triggered immediately to generate the corresponding elevator call request command 221, and does not necessarily send the generated corresponding elevator call request command 221 immediately. In an embodiment, the elevator call request command generating unit 220 automatically generates the corresponding elevator call request command 221 when the signal strength of the sensed wireless signal 123 is greater than or equal to trigger threshold strength. At this point, a distance between a position point where the signal strength is equal to the trigger threshold strength and the wireless signal apparatus reflects an elevator call distance. Generally, the passenger 90 first enters the coverage S910, and if the passenger 90 continues to approach the wireless signal apparatus 120, the personal mobile terminal 200 will be triggered automatically to generate and send an elevator call request command 221.

Using the application scenario shown in FIG. 2 as an example, when two passengers enters the elevator landing zone 410 (such as a lobby waiting area), the personal mobile terminal 200-1 or 200-2 (such as a mobile phone, regardless of whether the mobile phone is held in the hand or put in a handbag) carried by the passengers will automatically sense the wireless signal 123 broadcasted by the wireless signal apparatus 120 installed in the elevator landing zone 410. For example, if a distance from the personal mobile terminal 200-1 or 200-2 to the wireless signal apparatus 120 is less than or equal to an elevator call distance, the personal mobile terminal 200-1 or 200-2 will establish a handshake connection, such as a Bluetooth connection, with the wireless signal apparatus 120 based on the wireless signal 123. The personal mobile terminal 200-1 or 200-2 automatically sends an elevator call request command at least including elevator call direction information, thus automatically completing an elevator call request operation. The passenger neither needs to manually press an elevator call button installed on an elevator call request input device nor needs to manually operate the personal mobile terminal 200-1 or 200-2.

Therefore, by configuring the automatic elevator call system 20 in the elevator system 10 according to the embodiment of the present invention, the passenger 90 carrying the personal mobile terminal 200 can complete the elevator call request operation automatically or in a hand free manner, which can significantly improve passenger experience in terms of the elevator call operation.

Further, the elevator controller 140 of the elevator system 10 can be coupled to the wireless signal apparatus 120 and can control running of one or more elevator cars 110 in the elevator system 10 in response to at least the elevator call request command. For example, the elevator controller 140 can schedule a corresponding elevator car 110 for the passengers 90-1 and 90-2 and control the elevator car 110 to stop at the landing corresponding to the elevator landing zone 410, so that the passengers 90-1 and 90-2 enter the elevator car 110.

It should be noted that the automatic elevator call system 20 in the embodiments shown in FIG. 1 and FIG. 3 generally sends the elevator call request command 221 only once. In other words, the automatic elevator call system 20 automatically sends the elevator call request command 221 only once when the passenger 90 carrying the personal mobile terminal 200 enters the elevator landing zone 410, thus avoiding the generation of redundant abnormal elevator call operations.

However, the applicant finds that the following situations, for example, will cause the generation of abnormal elevator call operations: In the first situation, after a passenger 90 entering the elevator landing zone 410 and automatically sending an elevator call request command 221 to the wireless signal apparatus 120 once through the personal mobile terminal 200, for example, the passenger 90 makes a long-time conversation or call and does not enter the corresponding elevator car, the elevator call request command 221 is automatically canceled by the elevator controller 140 after the elevator car 110 stops. If the personal mobile terminal 200 continues to automatically send the elevator call request command 221 again, the elevator call request command 221 resent subsequently may also be invalid (because the passenger 90 probably is still in conversation or on the call). In the second situation, the passenger 90 walks back and forth on the boundary 1231 (for example, the passenger 90 is on the call) and therefore repeatedly enters the boundary 1231 frequently. This may cause the personal mobile terminal 200 to frequently send the elevator call request command 221, generating abnormal elevator call request operations, which may cause the door of the stopping elevator car to fail to open in a severe case.

In order to further solve the foregoing problems, in an embodiment, as shown in FIG. 3, a timing unit 230 is disposed in the personal mobile terminal 200. The timing unit 230 is configured to calculate duration information T1 from the moment when the personal mobile terminal 200 leaves the coverage of the wireless signal 123 to the moment when the personal mobile terminal 200 enters the coverage again. For example, the timing unit 230 starts continuous timing from the moment when the personal mobile terminal 200 crosses the boundary 1231 from inside the coverage, and stops timing when the personal mobile terminal 200 returns into the boundary 1231 again, to generate the duration information T1. For example, whether the personal mobile terminal 200 leaves the coverage of the wireless signal 123 or enters the coverage of the wireless signal 123 can be determined by using the short range communication unit 210.

An enabling unit 240 is further disposed in the personal mobile terminal 200. When the duration information T1 is less than or equal to a preset time threshold $T_{th}$, the enabling unit 240 causes the personal mobile terminal 200 to be incapable of automatically sending the elevator call request command 221 in a time period from the moment when the personal mobile terminal 200 enters the coverage again to the moment when the personal mobile terminal 200 leaves the coverage again. For example, the automatic elevator call function enabling unit 240 of the personal mobile terminal 200 is turned off in the time period. For example, the function of the elevator call request command generating unit 220 is turned off and/or the function of establishing a Bluetooth connection and sending an elevator call request command 221 of the short range communication unit 210 is turned off.

In an implementation solution, the enabling unit 240 judges whether the duration information T1 is less than or equal to the preset time threshold $T_{th}$. If $T1<T_{th}$, the current leaving of the passenger 90 from the coverage lasts an excessively short time, and it is judged that the passenger 90 probably does not actually enter the elevator landing zone 410 from the outside. For example, it is judged that the leaving and next entry within the T1 time correspond to the foregoing second situation in which the passenger 90 walks back and forth on the boundary 1231 (for example, the passenger 90 is on the call). The enabling unit 240 can temporarily suspend the elevator call function. That is, in a period from the moment of entering the coverage again to the moment of leaving the coverage next time, the automatic elevator call function cannot be triggered no matter how the passenger 90 moves in the boundary 1231. If $T1>T_{th}$, the passenger 90 leaves the coverage for a long time, and the enabling unit 240 judges that the passenger 90 probably actually enters the elevator landing zone 410 from the outside. The enabling unit 240 can recover the automatic elevator call function. For example, once the short range communication unit 210 senses in the boundary 1231 that the signal strength of the wireless signal 123 is greater than or equal to the trigger threshold strength, the personal mobile terminal 200 will be capable of sending the elevator call request command 221 automatically.

In an implementation solution, the predetermined time threshold $T_{th}$ can be selectively set to a value greater than or equal to 15 seconds and less than or equal to 2 minutes (for example, 20 seconds or 70 seconds). In order to judge the real elevator-taking service requirement of the passenger 90 more accurately, the time threshold $T_{th}$, can be selectively set to a value greater than or equal to 30 seconds and less than or equal to 1 minute (such as 40 seconds or 50 seconds). It will be appreciated that many factors such as a specific application scenario can affect the value of the time threshold $T_{th}$. If the time threshold $T_{th}$ is set to be excessively short, for example, it is difficult to accurately eliminate frequent elevator calls caused by back-and-forth walking of the passenger 90 on the boundary 1231 (for example, the passenger 90 is on the call) in the second situation above. If the time threshold $T_{th}$ is set to be excessively long, the automatic elevator call function of the personal mobile terminal 200 will be suspended for an excessively long time, affecting passenger experience. For example, in the foregoing first situation, the passenger 90 does not enter the elevator car 110; if the passenger wants to complete the elevator call request operation again by using the automatic elevator call function of the personal mobile terminal 200, the passenger 90 has to leave the coverage of the wireless signal 123 and stay out of the coverage for a period of time (longer than the time threshold $T_{th}$), and then enters the coverage of the wireless signal 123 again. If the passenger 90 has to stay outside the coverage for an excessively long time (because the time threshold $T_{th}$ is set to be excessively long), it may affect elevator call experience of the passenger 90.

In an implementation solution, an input unit 250 is further disposed in the personal mobile terminal 200. The input unit 250 can be configured to input request service information about the elevator call request command. The personal mobile terminal 200 generates and sends the corresponding elevator call request command 123 based on the input service request information. Therefore, through the input unit 250, the passenger 90 can complete the elevator call request operation in a manual inputting manner. As such, even if the automatic elevator call function of the personal mobile terminal 200 is suspended by the enabling unit 240, the passenger 90 can still complete the elevator call request operation smoothly in a manual inputting manner as required. The manual elevator call operation can achieve a good supplement for the automatic hands-free elevator call operation.

In an application scenario of the automatic elevator call system 20 in the foregoing embodiment, the passenger 90 carrying the mobile terminal 200 enters the elevator landing zone 410 from outside of the building (for example, the passenger 90 enters a lobby landing zone). Once reaching the boundary 1231, the personal mobile terminal 200 will be capable of sensing the wireless signal 123. The short range communication unit 210 can determine that the personal mobile terminal 200 enters the coverage of the wireless signal 123. In a process that the personal mobile terminal 200 further approaches the wireless signal apparatus 123, signal strength of the wireless signal 123 sensed by the personal mobile terminal 200 increases, and when the signal strength exceeds the trigger threshold strength, the personal mobile terminal 200 automatically generates and sends the corresponding elevator call request command 221. For example, the personal mobile terminal 200 sends the elevator call request command 221 once by establishing a Bluetooth connection with the wireless signal apparatus 120, so that the passenger 90 completes the elevator call request operation in a hand free manner. If the passenger 90 misses an elevator car 110 scheduled with respect to the elevator call request command 221 because the passenger 90 meets a friend in the elevator landing zone 410 and talks with the friend for a long time or the elevator car 110 is overcrowded, the elevator call request command 221 is automatically cleared by the elevator controller 140. As the passenger 90 stays in the coverage of the wireless signal 123, the personal mobile terminal 200 will not send the elevator call request command again for the passenger 90, avoiding an invalid elevator call operation caused by, for example, a long-time conversation of the passenger 90 in the elevator landing zone 410. In this case, if the passenger 90 needs to complete the elevator call request operation again, the operation can be completed in the following two manners: In one manner, the passenger 90 can input an elevator call request operation manually through the input unit 250. In the other manner, the passenger can leave the coverage for about 60 seconds (for example, time threshold $T_{th}$=50 seconds) and then enter the coverage again to wait for the elevator, and the personal mobile terminal 200 automatically sends the elevator call request command again based on sensing of the wireless signal 123.

In another application scenario of the automatic elevator call system 20 in the foregoing embodiment, the passenger 90 carrying the mobile terminal 200 moves back and forth on the boundary 1231 (for example, the passenger 90 is on the call near the boundary 1231) and therefore frequently enters the coverage S910 and leaves the coverage S920. The timing unit 230 will calculate duration information T1 of a time period between the moment when the passenger leaves the coverage S920 each time and the moment when the passenger 90 enters the coverage S910 next time. For example, T1 is generally about 3-10 S. Because T1 is less than the time threshold $T_{th}$ (for example, $T_{th}$=50 seconds), in the time period from the moment when the passenger 90 enters the coverage S910 next time to the moment when the passenger 90 leaves the coverage S920 again, the enabling unit 240 will suspend the automatic elevator call operation function. Therefore, the elevator call request command 221 cannot be sent automatically, avoiding frequent abnormal automatic elevator call operations.

Therefore, the automatic elevator call system 20 in the foregoing embodiment can effectively avoid abnormal or invalid automatic elevator call operations in some scenarios caused by the automatic elevator call function. The running efficiency of the elevator system 10 can be guaranteed.

It should be noted that the timing unit 230 of the automatic elevator call system is not limited to being disposed in the foregoing personal mobile terminal 200 shown in FIG. 3 above. In other alternative embodiments, for example, the timing unit 230 can also be disposed in the wireless signal apparatus 120, and can even be disposed in a landing zone, or the timing unit 230 can be installed independently. Similarly, the enabling unit 240 of the automatic elevator call system is not limited to being disposed in the foregoing personal mobile terminal 200 shown in FIG. 3 either; the enabling unit 240 can be disposed at another place together with the timing unit 230, and can implement its function by sending an instruction to the personal mobile terminal 200.

Figure 4:
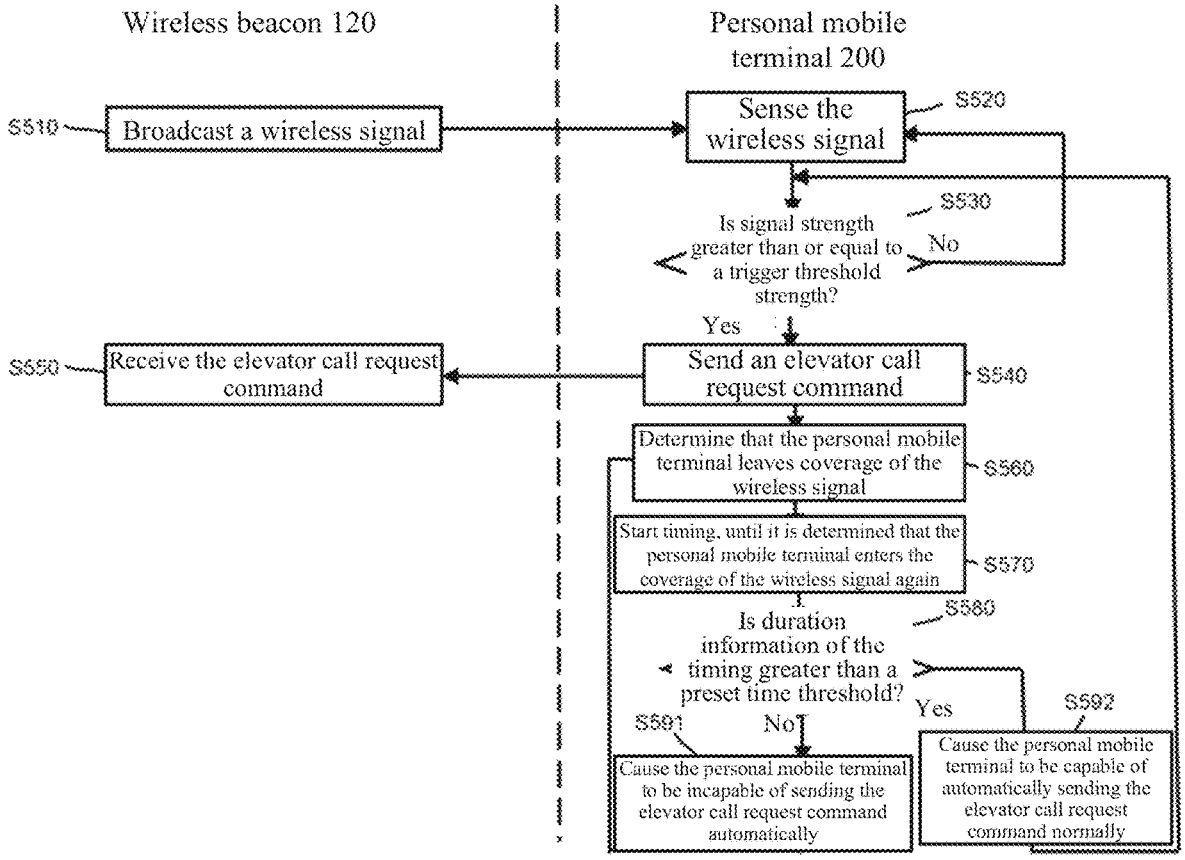
FIG. 4 is a flowchart of an automatic elevator call control method according to an embodiment of the present invention.

FIG. 4 is a flowchart of an automatic elevator call control method according to an embodiment of the present invention. A method for determining an abnormal elevator call request in this embodiment is described in detail with reference to FIG. 1, FIG. 2 and FIG. 4.

At the side of the wireless signal apparatus 120, as shown in FIG. 4, in step 510, the wireless signal apparatus 120 can continuously broadcast the wireless signal 123 for example. At the side of the personal mobile terminal 200, once entering the coverage of the wireless signal 123, i.e., once entering the boundary 1231, the personal mobile terminal 200 carried by the passenger 90 can start sensing the wireless signal 123, i.e., step S520.

Further, in step S530, it is judged whether sensed signal strength is greater than or equal to a trigger threshold strength, that is, it is judged based on the trigger threshold strength whether to send an elevator call request command 221 automatically. For example, if the signal strength of the sensed wireless signal 123 is greater than or equal to the trigger threshold strength, the judgment result is "yes", and the personal mobile terminal 200 is automatically triggered to generate the elevator call request command 221 and send the elevator call request command 221 to the wireless signal apparatus 120, i.e., step S540; otherwise, the judgment result is "no", and step S520 is performed.

Correspondingly, the side of the wireless signal apparatus 120 receives the elevator call request command 221, i.e., step S550. As such, one elevator call request operation process is completed automatically. In the process of step S520 to step S540, the elevator call request command is sent only once.

Further, if the passenger 90 in the coverage leaves the coverage, it can be determined that the personal mobile terminal 200 leaves the coverage of the wireless signal 123 according to the change of the sensed wireless signal 123 in the leaving process, i.e., step S560.

Further, timing is started from the moment when the personal mobile terminal 200 leaves the coverage, for example, the moment when the personal mobile terminal 200 cannot sense the wireless signal 123; the timing continues till the personal mobile terminal 200 enters the coverage of the wireless signal 123 again (for example, the timing continues till the moment when the wireless signal 123 is sensed again), and corresponding duration information T1 is obtained through timing, i.e., step S570.

Further, in step S580, it is judged whether the duration information T1 of the timing is greater than a preset time threshold $T_{th}$.

If the judgment result is "yes", the personal mobile terminal 200 judges that the passenger really enters the coverage again and wants to call the elevator; therefore, the personal mobile terminal 200 can automatically send the elevator call request command 221 normally in the time period from the moment of entering the coverage again to the moment of leaving the coverage again, and then step S530 is performed to enter the automatic elevator call request operation process of step S530 and step S540. Once the judgment result in step S530 is "yes", the elevator call request command is automatically sent once for the entry into the coverage again.

If the judgment result is "no", the personal mobile terminal 200 judges that the passenger does not really enter the coverage again; therefore, the personal mobile terminal 200 cannot automatically send the elevator call request command 221 normally in the time period from the moment of entering the coverage again to the moment of leaving the coverage again, and then step S560 is performed. The automatic elevator call function of the personal mobile terminal 200 is not restarted until the judgment result of step S580 is "yes" when the personal mobile terminal 200 enters the coverage again.

Definitely, as another option, after step S591, the automatic elevator call control process can be intervened by means of a manual operation. For example, request service information about the elevator call request command is input manually, thus completing the elevator call request operation based on the input request service information.

Therefore, the automatic elevator call control method in the foregoing embodiment of the present invention can accurately avoid invalid or abnormal elevator call request operations, and reduce negative effects of these elevator call request operations on running of the elevator system 10.

It should be noted that the personal mobile terminal 200 in the above embodiment of the present invention can be implemented by using computer program instructions, e.g., implemented by a specific APP. These computer program instructions may be provided to a processor of a general-purpose computer, a special-purpose computer, or another programmable data processing device to form the personal mobile terminal 200 in the embodiment of the present invention. Moreover, the processor of the computer or another programmable data processing device may execute these instructions to create units or components for implementing functions/operations designated in these flowcharts and/or blocks and/or one or more of the flowchart blocks.

Moreover, these computer program instructions may be stored in a computer readable memory. These instructions can instruct the computer or another programmable processor to implement the functions in specific manners, such that these instructions stored in the computer readable memory construct a product including instruction components for implementing functions/operations specified in one or more blocks of the flowcharts and/or block diagrams.

It should be further noted that in some alternative implementations, the functions/operations shown in the blocks may not take place according to the sequence shown in the flowchart. For example, two blocks shown sequentially may be performed substantially at the same time, or these blocks sometimes may be performed in a reversed order, which specifically depends on the functions/operations involved.

It should be noted that elements (including the flowcharts and block diagrams in the accompanying drawings) disclosed and depicted in this text refer to logic boundaries between elements. However, according to software or hardware engineering practices, the depicted elements and functions thereof can be executed on a machine by using a computer executable medium. The computer executable medium has a processor that can execute a program instruction stored thereon. The program instruction serves as a single-chip software structure, an independent software module, or a module using an external program, code, service or the like, or any combination thereof. Moreover, all these execution solutions may fall within the scope of the present disclosure.

Although different non-limitative implementation solutions have components that are specifically illustrated, the implementation solutions of the present invention are not limited to these specific combinations. Some of the components or features from any non-limitative implementation solution may be combined with features or components from any other non-limitative implementation solution.

Although specific step sequences are shown, disclosed and required, it should be understood that the steps may be implemented in any sequence, separated, or combined, and they will still benefit from the present disclosure unless otherwise specified.

The foregoing descriptions are exemplary and are not defined to be limitative. Various non-limitative implementation solutions are disclosed in this text; however, according to the foregoing teaching, those of ordinary skill in the art will be aware that various modifications and variations will fall within the scope of the appended claims. Therefore, it should be understood that disclosure content other than those specifically disclosed can be implemented within the scope of the appended claims. Therefore, the appended claims should be read up to determine the real scope and content.

What is claimed is:

1. An automatic elevator call system, comprising:

a wireless signal apparatus, installed in an elevator landing zone of an elevator system and broadcasting a corresponding wireless signal around;

wherein the wireless signal apparatus receives an elevator call request command automatically sent by a personal mobile terminal carried by a passenger in the case where the personal mobile terminal senses the wireless signal;

wherein the automatic elevator call system further comprises: a timing circuitry configured to calculate duration information from the moment when the personal mobile terminal leaves coverage of the wireless signal to the moment when the personal mobile terminal enters the coverage again;

an enabling circuitry configured to: when the duration information is less than or equal to a preset time threshold, cause the personal mobile terminal to be incapable of automatically sending the elevator call request command in a time period from the moment when the personal mobile terminal enters the coverage again to the moment when the personal mobile terminal leaves the coverage again; and an input circuitry disposed in the personal mobile terminal, wherein the input circuitry is configured to input request service information about the elevator call request command.

2. The automatic elevator call system according to claim 1, wherein the timing circuitry and/or the enabling circuitry are/is disposed in the personal mobile terminal carried by the passenger.

3. The automatic elevator call system according to claim 1, wherein the enabling circuitry is further configured to: when the duration information is greater than the preset time threshold, cause the personal mobile terminal to be capable of automatically sending the elevator call request command normally in a time period from the moment when the personal mobile terminal enters the coverage again to the moment when the personal mobile terminal leaves the coverage again.

4. The automatic elevator call system according to claim 1, wherein the time threshold is greater than or equal to 15 seconds and less than or equal to 2 minutes.

5. The automatic elevator call system according to claim 1, wherein the time threshold is greater than or equal to 30 seconds and less than or equal to 1 minute.

6. The automatic elevator call system according to claim 1, wherein the automatic elevator call system further comprises a short range communication circuitry disposed in the personal mobile terminal, and the short range communication circuitry is configured to sense the wireless signal and determine whether the personal mobile terminal leaves or enters the coverage.

7. The automatic elevator call system according to claim 6, wherein the short range communication circuitry is further configured to determine that the personal mobile terminal leaves the coverage in the case where the wireless signal is sensed at first and then not sensed or in the case where signal strength of the sensed wireless signal gradually decreases to approximately 0; and the short range communication circuitry is further configured to determine that the personal mobile terminal enters the coverage in the case where the wireless signal is not sensed at first and then sensed.

8. The automatic elevator call system according to claim 1, further comprising an elevator call request command generating circuitry disposed in the personal mobile terminal, wherein the elevator call request command generating circuitry is configured to automatically generate the corresponding elevator call request command when signal strength of the sensed wireless signal is greater than or equal to trigger threshold strength.

9. The automatic elevator call system according to claim 1, wherein the enabling circuitry is further configured to be capable of automatically sending the elevator call request command only once in a time range from the moment of entering the coverage to the moment of leaving the coverage.

10. The automatic elevator call system according to claim 1, wherein the wireless signal apparatus is a Bluetooth module/Bluetooth Low Energy (BLE) module, and the wireless signal is a Bluetooth signal/BLE signal.

11. An automatic elevator call control method, comprising steps of:

sensing a wireless signal broadcasted by a wireless signal apparatus installed in an elevator landing zone of an elevator system;

calculating duration information from the moment when a personal mobile terminal leaves coverage of the wireless signal to the moment when the personal mobile terminal enters the coverage again;

when the duration information is less than or equal to a preset time threshold, causing the personal mobile terminal to be incapable of automatically sending an elevator call request command in a time period from the moment when the personal mobile terminal enters the coverage again to the moment when the personal mobile terminal leaves the coverage again; and manually inputting request service information about the elevator call request command.

12. The automatic elevator call control method according to claim 11, further comprising a step of:

when the duration information is greater than the preset time threshold, causing the personal mobile terminal to be capable of automatically sending the elevator call request command normally in a time period from the moment when the personal mobile terminal enters the coverage again to the moment when the personal mobile terminal leaves the coverage again.

13. The automatic elevator call control method according to claim 11, further comprising steps of: determining that the personal mobile terminal leaves the coverage in the case where the wireless signal is sensed at first and then not sensed or in the case where signal strength of the sensed wireless signal gradually decreases to approximately 0; and determining that the personal mobile terminal enters the coverage in the case where the wireless signal is not sensed at first and then sensed.

14. The automatic elevator call control method according to claim 11, further comprising a step of:

automatically generating the corresponding elevator call request command when signal strength of the sensed wireless signal is greater than or equal to trigger threshold strength.

15. The automatic elevator call control method according to claim 11, wherein the elevator call request command can be automatically sent only once in a time range from the moment of entering the coverage to the moment of leaving the coverage.

16. A non-transitory computer readable storage medium, storing a computer program, wherein the program can be executed by a processor to implement steps of the automatic elevator call control method according to claim 11.

17. An elevator system, comprising:

the automatic elevator call system according to claim 1; and an elevator controller configured to control running of one or more elevator cars in the elevator system;

wherein the elevator controller is coupled to the wireless signal apparatus and controls the running of the one or more elevator cars in the elevator system in response to at least the elevator call request command.

* * * * *